US012607093B2

(12) United States Patent
Jarvis et al.

(10) Patent No.: US 12,607,093 B2
(45) Date of Patent: Apr. 21, 2026

(54) RETRIEVABLE PACKER APPARATUS

(71) Applicant: METROL TECHNOLOGY LIMITED, Aberdeen (GB)

(72) Inventors: Leslie Jarvis, Stonehaven (GB); Shaun Ross, Aberdeen (GB); David Martin, Aberdeen (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 144 days.

(21) Appl. No.: 18/286,378

(22) PCT Filed: Apr. 13, 2022

(86) PCT No.: PCT/GB2022/050926
§ 371 (c)(1),
(2) Date: Oct. 11, 2023

(87) PCT Pub. No.: WO2022/219330
PCT Pub. Date: Oct. 20, 2022

(65) Prior Publication Data

US 2024/0191597 A1 Jun. 13, 2024

(30) Foreign Application Priority Data

Apr. 13, 2021 (GB) ..... 2105268

(51) Int. Cl.
*E21B 23/06* (2006.01)
*E21B 33/12* (2006.01)
(Continued)

(52) U.S. Cl.
CPC ..... *E21B 34/066* (2013.01); *E21B 33/12* (2013.01); *E21B 2200/04* (2020.05); *E21B 2200/06* (2020.05)

(58) Field of Classification Search
CPC .... E21B 23/06; E21B 33/129; E21B 33/1294; E21B 34/06
See application file for complete search history.

(56) References Cited

U.S. PATENT DOCUMENTS 2,309,383 A 1/1943 Crites
4,480,690 A 11/1984 Vann
(Continued)

FOREIGN PATENT DOCUMENTS

GB 1192795 5/1970
GB 2263118 7/1993
(Continued)

OTHER PUBLICATIONS

International Search Report and Written Opinion for PCT/GB2022/050926, Jun. 10, 2022.

*Primary Examiner* — Kenneth L Thompson
(74) *Attorney, Agent, or Firm* — Womble Bond Dickinson (US) LLP

(57) ABSTRACT

An apparatus comprising a mandrel (51, 251, 351) having a main longitudinal direction and defining a throughbore in that direction and a packer element (52, 352) mounted thereon. A seal bore extension (122) is attached, directly or indirectly, to the mandrel, and defines a bore (122*b*) in the main longitudinal direction. A floating seal (60) is provided between the bore of the seal bore extension and an internal moveable tube/stinger (120). A bypass channel (54, 254) extends across the packer element between an upper bypass port (50U, 250U) and a lower bypass port (50L, 250L), generally in said longitudinal direction. A bypass valve (55, 255) controls said upper or lower bypass port. The valve may move more than once and may be a multi-cycle valve. An electronic communication device (56*a*, 256) comprising a wireless receiver is configured to receive wireless signals
(Continued)

such as EM or acoustic, to control the bypass valve. In this way the safety of well testing can be improved.

59 Claims, 9 Drawing Sheets

(51) Int. Cl.
*E21B 33/129* (2006.01)
*E21B 34/06* (2006.01)

(56) References Cited

U.S. PATENT DOCUMENTS

| | | | | |
|---|---|---|---|---|
| 4,722,400 | A | 2/1988 | Burns | |
| 6,367,566 | B1 | 4/2002 | Hill | |
| 8,550,172 | B2 * | 10/2013 | Frisby | E21B 34/10 166/242.6 |
| 10,167,696 | B2 * | 1/2019 | Foubister | E21B 43/08 |
| 10,174,582 | B2 * | 1/2019 | Windegaard | E21B 33/1294 |
| 10,280,718 | B2 * | 5/2019 | Broussard | E21B 33/10 |
| 12,486,743 | B2 * | 12/2025 | Alharbi | E21B 47/07 |
| 2003/0042026 | A1 | 3/2003 | Vinegar et al. | |
| 2006/0124295 | A1 | 6/2006 | Maguire | |
| 2008/0023205 | A1 | 1/2008 | Craster et al. | |
| 2009/0084550 | A1 | 4/2009 | Korte et al. | |
| 2011/0114333 | A1 | 5/2011 | Fenton | |
| 2012/0298380 | A1 | 11/2012 | Rogers et al. | |
| 2016/0237779 | A1 | 8/2016 | Husby et al. | |

FOREIGN PATENT DOCUMENTS

| | | |
|---|---|---|
| WO | 2000063520 | 10/2000 |
| WO | 2004/018833 | 3/2004 |
| WO | 2012/010897 | 1/2012 |

* cited by examiner

RETRIEVABLE PACKER APPARATUS

CROSS REFERENCE TO RELATED APPLICATIONS

This application is a 35 U.S.C. 371 National Stage of International Application No. PCT/GB2022/050926, PACKER filed Apr. 13, 2022, titled "RETRIEVABLE APPARATUS," which claims priority to GB Application No. 2105268.3, filed Apr. 13, 2021, titled "RETRIEVABLE PACKER APPARATUS," all of which are incorporated by reference herein in their entirety.

This invention relates to a retrievable packer apparatus especially one for use in a well test such as a Drill Stem Test (DST) of an oil and gas well.

In order to assess well characteristics such as pressure or permeability, it is known to conduct well tests such as a Drill Stem Test (DST).

FIG. 1 shows a known test well showing a Blow-Out-Preventor (BOP) 10 sealing a tubing string 12 in an annulus by pipe rams 13. The pipe rams 13 may seal on a special section of pipe, known as a slick joint, incorporating bypass for cables and control lines. The tubing string 12 extends into the well 1 for perhaps 100s or 1000s of metres depending on the depth of the specific well.

An expansion slip joint 14 is provided in the tubing string 12, between drill collars 17*a* & 17*b*, to allow for expansion/contraction caused by pressure and temperature variations. Below the slip joint 14 is a tester valve 18 which includes a circulating sleeve valve allowing or resisting communication between the tubing string 12 and an annulus 15 between the tubing string 12 and casing 11, and a ball valve which selectively allows or resists fluid to continue up or down the tubing string 12.

A packer 26 is provided in the well to seal the annulus 15. Hydrocarbon fluids from the reservoir are produced through lower circulation flow ports/valve 24, into the tubing string 12 to the surface. Production of the fluids is assessed to infer various characteristics of the reservoir (not shown).

At the completion of the well test, the string 12 is full of hydrocarbons which need to be removed.

Fluid, such as brine, is pumped into the annulus 15 and the tester valve 18 configured to open its circulating sleeve valve and close its ball valve. This circulates the fluid back up the tubing string 12 which displaces the hydrocarbons in the tubing string 12 thereabove to the surface. The circulating sleeve valve of the tester valve 18 is then closed and the ball valve opened, and more fluid pumped back into the tubing string 12 from the surface to push or "bullhead" hydrocarbons below the tester valve 18 back into the reservoir.

At the end of the test it is critical to remove hydrocarbons from the tubing string 12 in the well. Therefore, above the tester valve 18 is a back-up circulating sleeve valve 16 in case the tester valve 18 fails, for example if the circulating valve in the tester valve 18 fails in a closed position. The back-up circulating valve 16 includes a rupture disk which can be ruptured by pressuring up the annulus 15 to allow fluids to be pumped down the annulus 15 into the tubing string 12.

In an alternative to the FIG. 1 configuration, an expansion joint is provided with the packer. This simplifies the tubing string run above, which may need less expansion joints and/or drill collars, but otherwise has the same FIG. 1 features.

However, this increases the distance between the packer element and the flow ports below, to for example 6-10 m. An annulus below the packer and above the flow ports tends to build up with hydrocarbon gas and may be referred to as a "gas cap" and needs to be removed after the well test.

WO 00/63520 discloses such an arrangement. Page 5 line 27-page 6 line 10 describe a rupture disk 157 that can rupture to establish fluid communication between a lower annulus 71 and an upper annulus 72 across the packer 80 and so allows kill fluid introduced from the surface to progress past the packer 80 and direct the gas cap and any other hydrocarbons into flow ports and circulate up the tubing.

However, as noted above, the back-up circulating sleeve higher up the string includes a rupture disk which could not be activated if the rupture disk in the packer was ruptured and pressure communication was open to the formation, as it may not then be possible to sufficiently pressure up the annulus. Accordingly, in practise, because it is significantly more important to remove hydrocarbons from the tubing string rather than the relatively small trapped hydrocarbons in the gas cap, the skilled person does not use a bypass across the packer.

Instead, in practise, the rams sealing the annulus at surface are disengaged and the tubing string moved, insodoing disengaging the packer giving access to the gas below the packer (which starts to rise). The rams are then quickly re-engaged and fluid pumped down through choke and kill lines 9 into the annulus to control the rising gas and circulate it up through the lower ports and optionally bullhead it into the reservoir.

Whilst practised in the industry, the present inventors have noted that this loses control of the annulus for a short period of time and involves associated risks. For example, an unforeseen obstruction could hinder re-engagement of the rams.

An object of the present invention is therefore to improve the safety of well testing and/or well kill operations.

According to a first aspect of the present invention, there is provided a retrievable packer apparatus comprising:

- a mandrel having a main longitudinal direction, the mandrel defining a throughbore in the main longitudinal direction;
- a packer element mounted on the mandrel;
- a seal bore extension attached, directly or indirectly, to the mandrel, the seal bore extension defining a bore in the main longitudinal direction;
- a seal between the bore of the seal bore extension and an internal moveable tube;
- a bypass channel extending across the packer element between an upper bypass port and a lower bypass port, the bypass channel extending generally in said longitudinal direction;
- a bypass valve controlling said upper or lower bypass port;
- and,
- an electronic communication device comprising a wireless receiver configured to receive wireless signals to control the bypass valve.

The inventors of the present invention have thus gone against the practise in the art to avoid bypass across the packer element.

The bypass valve may be moved more than once such as being opened and then closed. It may optionally be a multi-cycle valve.

The bypass valve is normally provided at the upper or lower port which it controls, although can be spaced therefrom. For example, it can be provided in the bypass channel, and thus indirectly control the upper or lower bypass ports.

The internal moveable tube also normally defines a bore in the main longitudinal direction. Normally, the bypass channel and bypass ports are isolated from the bore of the internal moveable tube, and normally from said bore of the seal bore extension; even when the bypass valve is in an open position. That is, the bypass channel is not normally in pressure communication with the bore of the internal moveable tube. And/or not normally in pressure communication with the main bore of the seal bore extension.

The bypass valve may be a sleeve valve.

The wireless signals may be acoustic, electromagnetic (EM), wired pipe, and/or coded pressure pulsing; optionally acoustic, EM, and/or coded pressure pulsing. Acoustic and/or EM are preferred.

The packer apparatus may be wirelessly controllable by at least two different forms wireless control chosen from the list consisting of acoustic, electromagnetic (EM), wired pipe, and coded pressure pulsing, especially form the list consisting of acoustic, electromagnetic (EM) and coded pressure pulsing, more especially from acoustic and electromagnetic.

The electronic communication device may be provided on the outside of the seal bore extension or below the seal bore extension and linked to the bypass valve by a hydraulic line or electrical control line passing over, or within a wall of, the seal bore extension.

A valve controller is usually provided for controlling the bypass valve. It may include a battery. Optionally it includes a control valve which in turn hydraulically controls the bypass valve. It may also function by stored pressure or a small pyrotechnic. Thus it can operate the valve by direct mechanical connection, such as a lead screw, or through pressure or current such as through a hydraulic or electric line.

The valve controller may also be provided on the outside of the seal bore extension or below the seal bore extension and linked to the bypass valve by a hydraulic line or electrical control line passing over, or within a wall of, the seal bore extension.

The inventors of the present invention have found that by such positioning of the electronic communication device and/or the valve controller, that the overall length of the apparatus can be reduced which makes it easier to handle while running.

The bypass flow area is determined by the minimum flow area of one of the ports, the valve and the bypass channel. The bypass flow area may range from 0.05 square inch (32 $mm^2$) to 4 square inch (2581 $mm^2$).

However, it tends to vary depending on whether the valve is a multicycle valve or a single-use/single-shot valve (e.g. based on a rupture disk). The bypass flow area when the valve is a multicycle valve may be at least 0.05 square inch (32 $mm^2$), optionally at least 0.25 square inch (161 $mm^2$) and may be up to 2 square inches (1290 $mm^2$). The bypass flow area when the valve is a single use/single shot valve may be at least 0.5 square inches (323 $mm^2$), and may be up to 4 square inches (2581 $mm^2$).

The bypass valve may comprise or further comprise a check valve. The bypass valve may be controllable from a closed position to a checked position and optionally to a non-checked open position. The check valve preferably restricts flow in the upward direction and permits flow in the downward direction, thus limiting the potential for gas to migrate from below the packer to above the packer.

The bypass channel may be defined, at least in part, between the internal moveable tube and the mandrel. Alternatively, the channel could be provided elsewhere, such as through the mandrel. Such alternative embodiments preferably have the bypass valve controlling the upper bypass port and normally the bypass valve controller provided above the packer element and normally the electronic communication device above the packer element.

The seal bore extension may be at least 5 m long. It may be a maximum of 15 m long. The seal is normally a floating seal. The extent of travel of the floating seal within the seal bore extension may be at least 5 metres.

The seal bore extension may be attached to the mandrel directly, or indirectly through a body of the valve for example. Normally, the seal bore extension has a wider diameter than the outer diameter of the internal moveable tube and normally a lower diameter than the diameter of the mandrel.

The upper or lower bypass port may each comprise multiple orifices.

The lower bypass port (or the uppermost orifice thereof) is preferably at most 5 m from the closer end of the packer element, more preferably less than 3 m or less than 2 m.

Fluid movement through the bypass ports may be in an upward direction as well as a downward direction.

The packer element is usually elastomeric, although non-elastomeric seals may also be used. The packer element may be comprised of multiple parts, the different parts may comprise different elastomers. The packer element may comprise non-elastomeric back-up elements, in particular metal back-up elements.

The packer apparatus normally includes an anchoring device such as packer slips, usually also provided on the mandrel, usually below the packer element. The lower bypass port is normally below the anchoring device and so the bypass channel normally extends from the lower bypass port past the anchoring device. Optionally, there is no port from the bypass channel to the area between the anchoring device and the packer element; that is the bypass channel is isolated from direct pressure communication with this area. In alternative embodiments, a further bypass port is provided in this area as set out further below.

The apparatus may comprise a setting mechanism especially including a piston. It may be activatable using stored pressure, or a pyrotechnic device. For certain embodiments, the apparatus includes a hydrostatic setting mechanism which has a low-pressure chamber, an activation port which in use can be in pressure communication with the annulus of the well usually above the packer element, and a piston driven by well pressure against the action of the low-pressure chamber. The activation port to the well may be on an outer diameter or an inner diameter of the apparatus, however usually the activation port only has access to one of the inner and outer diameter of the packer apparatus. The activation port is normally through the piston.

The setting mechanism may include a trigger device, such as a rupture disc or valve, which allows well pressure into a chamber through said activation port and moves the piston against the action of the low-pressure chamber. Movement of piston can then set the packer apparatus i.e. move the packer element radially outwards and usually also move the anchoring device radially outwards, to engage with an outer tubular such as a casing, or a wellbore. The valve of the setting mechanism may be wirelessly controlled.

The packer apparatus may comprise a primary release mechanism which can operate at a pre-determined load in order to release the packer element and usually the anchoring device from the radially extended set position to a relatively radially contracted unset position.

The primary release mechanism can comprise a releasable support member and a locking mechanism to lock the releasable support member in place.

For certain embodiments, the primary release mechanism is especially one which is activated to release by movement, normally upward movement, of the internal moveable tube (which is by pulling on the connected string). The primary release mechanism in use unseats or releases the packer apparatus from contact with the tubular (often casing) or wellbore it was set against.

The locking mechanism of the primary release mechanism may comprise a moveable annular support sleeve. The internal moveable tube normally includes a feature such as a shoulder engageable with a complementary feature on the moveable annular support sleeve. In this way, or by other means, movement of the internal moveable tube, then unlocks the releasable support member (e.g. an annular cone) holding the packer element (and usually the anchoring device) in place, in order to release the packer element and the anchoring device. Locks, referred to as dogs may release by moving from a recess in the releasable support member into a recess on the moveable annular support sleeve, such as it moves and its recess is aligned with the dogs.

For alternative embodiments, the primary release mechanism may comprise alternatives to an annular cone, such as a collet or shearing mechanism, Moreover, the packer apparatus can be configured such that said movement of the internal moveable tube opens a further bypass port (which is mechanically released) below the packer element which during retrieval allows fluid communication across the packer element, via at least a portion of the bypass channel, usually to least mitigate swabbing. Thus, the further bypass port may be in fluid communication with a portion of the bypass channel. Thus, this provides a further bypass fluid path across the packer element operable by the primary release mechanism. The further bypass flow area may be of larger cross-section than the bypass flow area.

Thus, following operation of the primary release mechanism, the packer apparatus, in normal use, may be retrievable by continued upward pulling of the internal moveable tube. For such embodiments, the packer apparatus (including the seal bore extension) may be recovered together.

The packer apparatus may also comprise a secondary release mechanism as a fail-safe. The secondary release mechanism may include a weak section which may be shearable at a pre-determined force. The weak section may be in the internal moveable tube which separates the internal moveable tube into two parts, allowing part of the apparatus and the tubing above to be retrieved.

The secondary release mechanism may be positioned such that, following operation of the secondary release mechanism, at least a portion of the primary release mechanism is accessible from the bore of the mandrel. Thus, the part of the packer apparatus which is left in the well following operation of the secondary release mechanism may be later retrieved by a tool which acts on the primary release mechanism and optionally a further profile. Thus in the event that the packer apparatus cannot be retrieved with the string with which it is deployed, if, for instance, the packer apparatus or string below are surrounded by debris, the packer apparatus and string below can subsequently be retrieved with a work string capable of exerting greater forces on the packer apparatus and string below.

The packer gauge diameter is the largest fixed outer diameter on the unset packer. The embodiments of the present invention normally have a packer gauge diameter greater than 5.75" (14.6 cm) and less than 8.6" (22 cm).

Certain relatively small embodiments have a packer gauge diameter greater than 5.75" (14.6 cm) and less than 6.25" (15.9 cm). Whilst other relatively large embodiments have a packer gauge diameter greater than 7.5" (19 cm) and less than 8.6" (22 cm).

For said relatively small embodiments the internal moveable tube may have a minimum inner diameter of at least 2.2" (5.6 cm) and usually a maximum of 2.5" (6.4 cm).

Whereas for the relatively large embodiments the internal moveable tube may have a minimum inner diameter of at least 2.8" (7.1 cm) optionally up to 4.0" (10.2 cm).

The bypass valve is usually above the uppermost position of the floating seal within the seal bore and especially for the smaller embodiments, the electronic communication device, usually together with the valve controller, may be below the lowermost position of the floating seal.

In alternative embodiments, the electronic communication device is provided, usually with the valve controller, on the outside of the seal bore extension, or within the body of the seal bore extension.

The packer apparatus is typically capable of sending signals back. This may relate to confirmation signals, bypass valve status/position or data, such as pressure or density data, detected at or around the packer apparatus. Thus, the packer apparatus may comprise a wireless transceiver, which comprises the wireless receiver. The packer apparatus may include sensors especially at least one pressure sensor. A pressure sensor may be added, or ported to, above and/or below the packer element.

The packer apparatus may comprise at least one battery optionally a rechargeable battery and/or microprocessor, such as in the valve controller. The electronic communication device may therefore be battery powered.

The packer apparatus, in its undeployed state, is usually less than 20 m long, optionally less than 15 m long, more optionally less than 10 m long; based on the internal moveable tube being in its midway position of its range of motion, in the seal bore extension.

In certain aspects, the packer apparatus includes many of said optional features.

Thus according to a second aspect, there is provided a retrievable packer apparatus comprising:

- a mandrel having a main longitudinal direction, the mandrel defining a throughbore in the main longitudinal direction;
- a packer element mounted on the mandrel;
- an anchoring device mounted on the mandrel;
- a seal bore extension attached, directly or indirectly, to the mandrel, the seal bore extension defining a bore in the main longitudinal direction;
- a floating seal between the bore of the seal bore extension and an internal moveable tube;
- a bypass channel extending between an upper bypass port above the packer element across the packer element and a lower bypass port below the packer element, the bypass channel extending generally in said longitudinal direction;
- a bypass valve controlling said first or second upper or lower bypass ports;
- an electronic communication device comprising a wireless receiver configured to receive wireless signals to control the bypass valve;
- a valve controller for controlling the bypass valve;
- a primary release mechanism activatable in use by upward movement of the internal moveable tube;

the primary release mechanism operable at a pre-determined load in order to release the packer element from a radially extended set position to a relatively radially contracted unset position;

a further bypass fluid path across the packer element operable by the primary release mechanism;

a secondary release mechanism configured to enable separation of the internal moveable tube at a further pre-determined upward force of the internal moveable tube;

wherein at least a portion of the primary release mechanism is accessible in use from the bore of the packer mandrel following release of the secondary release mechanism:

and the wireless receiver is configured to receive wireless signals in the form of at least one of acoustic, electromagnetic, or coded pressure pulse signals; and, the lower bypass port or an uppermost orifice of said lower bypass port is less than 2 metres below a closer end of the packer element; and, the travel of the floating seal within the seal bore extension is at least 5 metres; and having a packer gauge diameter greater than 5.75" (14.6 cm) and less than 8.6" (22 cm).

Other optional features set out for the first aspect of the invention and not part of said further aspect of the invention are also optional for said further aspect of the invention, and are not repeated here for brevity.

Wireless

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands within the pressure or flow rate variations and a transducer is used within the well/borehole to detect and/or generate the variations, and/or an electronic communication device is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected into the well.

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

Electromagnetic (EM) (sometimes referred to as Quasi-Static (QS)) wireless communication is normally in the frequency bands of: (selected based on propagation characteristics) sub-ELF (extremely low frequency)<3 Hz (normally above 0.01 Hz);

ELF 3 Hz to 30 Hz;

SLF (super low frequency) 30 Hz to 300 Hz;

ULF (ultra-low frequency) 300 Hz to 3 kHz; and,

VLF (very low frequency) 3 kHz to 30 KHz.

Where inductively coupled tubulars are used, there are normally at least ten, usually many more, individual lengths of inductively coupled tubular which are joined together in use, to form a string of inductively coupled tubulars. They have an integral wire and may be formed tubulars such as tubing drill pipe or casing. At each connection between adjacent lengths there is an inductive coupling. The inductively coupled tubulars that may be used can be provided by N O V under the brand Intellipipe®.

These forms of wireless signals are described in further detail in WO2017/203285 the disclosure of this publication being incorporated herein in its entirety by reference.

According to a third aspect of the invention, there is provided a well comprising the packer apparatus as described herein, and a tubing string sealed by rams of a blow-out preventor, the tubing string extending into casing of the well defining an annulus therebetween, the tubing string connected to the internal moveable tube of the packer apparatus;

wherein the packer element provides a seal between the casing and the mandrel of the packer apparatus.

Optional and preferred features of the first and/or second aspect of the invention, are independently optional and preferred features of the third aspect of the invention and will not be repeated herein for brevity.

The well may be a multi-zone well, optionally with valves, particularly sleeve valves between each zone.

The packer apparatus as described herein may be provided for any zone and may be especially useful above an upper or uppermost zone.

The rams may seal on a slick joint which also incorporates a bypass for cables and control lines.

In use, tubing from surface is connected to the internal moveable tube, so that fluids can flow from the tubing to the internal moveable tube, or in the opposite direction.

A tester valve is normally part of the tubing string. That is, a valve having circulating valve which selectively allows or resists communication between the tubing string and the annulus, and also a valve which selectively allows or resists fluid to continue up or down the tubing string. The circulating valve is normally above the ball valve. These valves may be provided as separate components and are not necessarily provided as part of a single tester valve.

Above the circulating valve (often part of a tester valve) a back-up circulation valve may be provided. It may be activated by a rupture disk or may be wirelessly activated.

A further circulation valve or circulation port may be provided below the packer element.

Perforating guns may be hung off the apparatus below the packer element. However certain wells may be pre-perforated or open hole and so perforating guns may not be necessary. References herein to perforating guns includes perforating punches or drills, all of which are used to create a flowpath between the reservoir and the well.

The packer apparatus is normally provided relatively deep in the well, such as at least 500 m, 1000 m or at least 1500 m deep in the well. This is measured from the surface of the well, which is defined herein as the top of the uppermost casing.

All references to casing herein include liners unless stated otherwise.

The well may be a subsea well. Wireless communications can be particularly useful in subsea wells because running cables in subsea wells is more difficult compared to land wells. The well may be a deviated or horizontal well, and embodiments of the present invention can be particularly suitable for such wells since they can avoid running wireline, cables or coiled tubing which may be difficult or not possible for such wells.

References such as "above" or "upward" and "below" or "downward" when applied to deviated or horizontal wells should be construed as their equivalent in wells with some vertical orientation. For example, "above" is closer to the surface of the well through the well.

The well may be a hydrocarbon well. It may be an exploration well.

The packer apparatus and/or the well may comprise at least one pressure sensor. The pressure sensor may be below the packer element and may or may not form part of the apparatus. It can be coupled (physically or wirelessly) to a wireless transmitter and data can be transmitted from the wireless transmitter to above the packer element or otherwise towards the surface. Data can be transmitted in at least one of the following forms: electromagnetic, acoustic, inductively coupled tubulars especially acoustic and/or electromagnetic; as described herein above.

In certain embodiments, the apparatus can be wirelessly controlled using the existing well infrastructure for data gathering or tester valve control.

The well may comprise relays which have a transceiver (or receiver) which can receive a signal, and an amplifier which amplifies the signal for the transceiver (or a transmitter) to transmit it onwards.

There may be at least one relay. The at least one relay (and the transceivers or transmitters associated with the apparatus or at the surface) may be operable to transmit a signal for at least 200 m through the well. One or more relays may be configured to transmit for over 300 m, or over 400 m.

According to a fourth aspect of the present invention, there is provided a method of controlling a well of the second aspect of the invention normally following a well test, the well in communication with a reservoir, the method comprising:

sending a wireless signal to the wireless receiver to cause the bypass valve to open;

directing fluid through the bypass channel.

Optional and preferred features of the first, second and/or third aspects of the invention, are independently optional and preferred features of the fourth aspect of the invention and will not be repeated herein for brevity.

In this way hydrocarbons, usually hydrocarbon gas, which has accumulated below the packer element can be recirculated through a circulation valve or port below the packer element and/or bull-headed back into the reservoir without disengaging the rams or the packer thus removing more hydrocarbons from the well whilst maintaining the integrity of the well barriers and improving the overall safety of the operation.

Thus, usually the step of opening the bypass valve can be performed whilst the rams are closed sealing the annulus. And/or usually the step of opening the bypass valve can be performed whilst the packer apparatus is engaged on the casing. And/or the step of opening the bypass valve can be performed when the back-up circulation safety valve is closed.

This reduces the possibility of hydrocarbon gas rising up in an uncontrolled manner and so can add to the safety in use.

The method of controlling the well may include the steps of adding fluid into the well annulus, circulating the fluids through an open circulating valve in the tubing and back towards the surface. The hydrocarbons above the circulating valve can be removed in this way. The method of controlling the well may also include the step of adding fluid into the tubing at surface and displacing hydrocarbons back into the reservoir, especially hydrocarbons around and below the circulating valve. These steps are normally conducted before opening the bypass valve.

The wireless signal is normally sent from the surface. For example an acoustic signal may be sent and optionally relayed down the well by relay devices. Coded pressure pulsing signals may be sent via the annulus above the packer apparatus.

The pressure in the annulus may be deliberately increased by at least 100 psi (689 kPa) before the bypass valve is opened.

In another aspect, the invention also provides a wider method of well testing, including:

setting the packer apparatus as described herein in the well;

conducting a well test;

unsetting and retrieving the packer apparatus.

The packer apparatus can be set using the hydrostatic setting mechanism described herein.

The well test may especially be a Drill Stem Test (DST). Other tests may be used, such as a closed chamber test, pulse test, interference test, injection test, frac test, or any other form of flow and/or build-up test. Thus well test may include the steps of perforating the casing below the packer.

The packer apparatus can be unset using the primary and/or secondary release mechanism described herein.

Particularly in embodiments with a multi-cycle bypass valve, the method of controlling the well may comprise opening and later closing the bypass valve to manage fluids within the well such as to lighten fluids within the well below the circulating valve to assist initial well flow, or to displace debris between the circulating ports below the packer and the circulating valve above the packer.

The bypass valve can also function as a further backup to the circulating valves above the packer for well kill in the event of failure of the circulation valves above the packer.

The fluid to control the well is any fluid, sometimes referred to as "kill weight fluid", which is used to provide hydrostatic head typically sufficient to overcome reservoir pressure. The fluid is normally a drilling mud-type fluid but other fluids such as brine and cement may be used.

Embodiments of the present invention will now be described, by way of example only, with reference to the accompanying figures.

Figure 1:
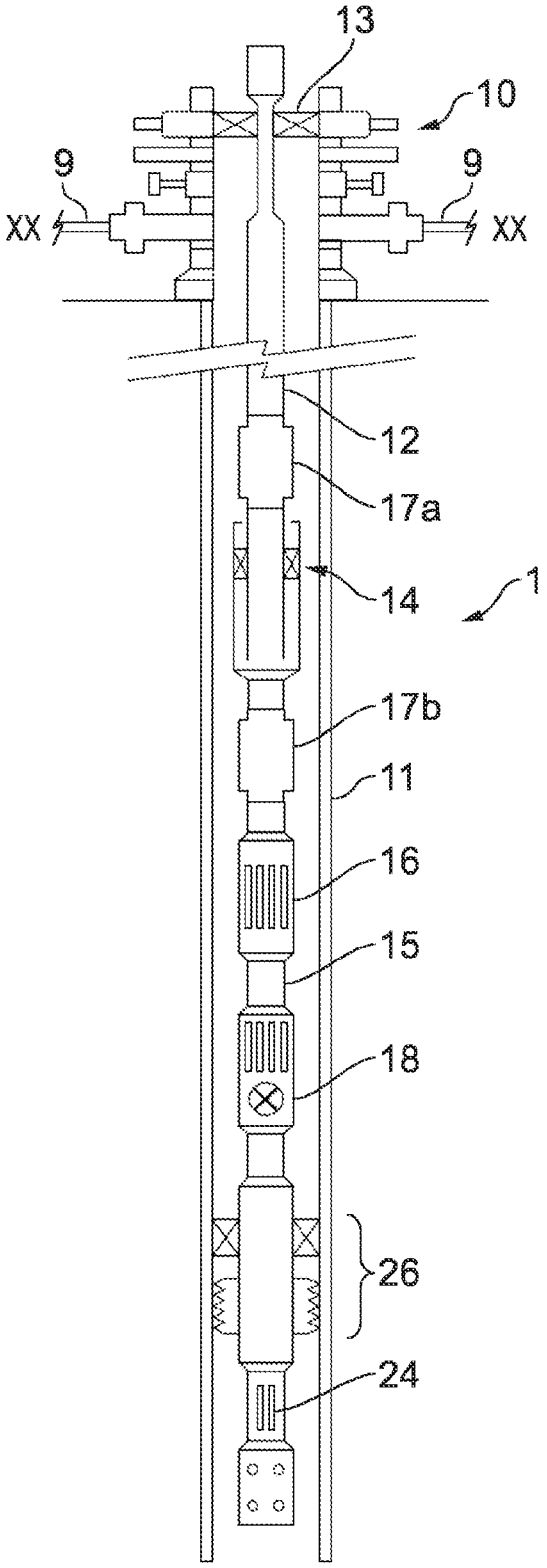
FIG. 1 (Prior Art)
FIG. 1 is a schematic view of a well arrangement showing a tubing string with a known packer apparatus.
Figure 2:
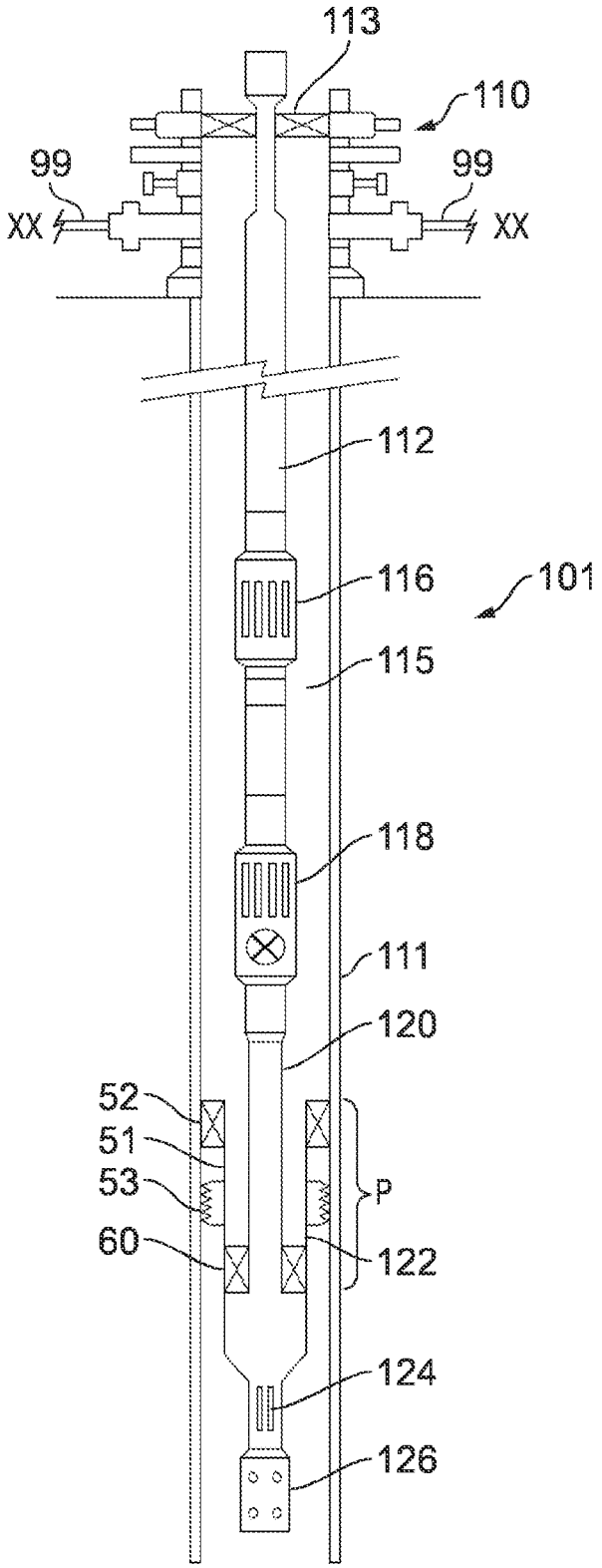
FIG. 2 is a schematic view of a well arrangement showing a tubing string with a packer apparatus in accordance with one aspect of the present invention.
Figure 3A:
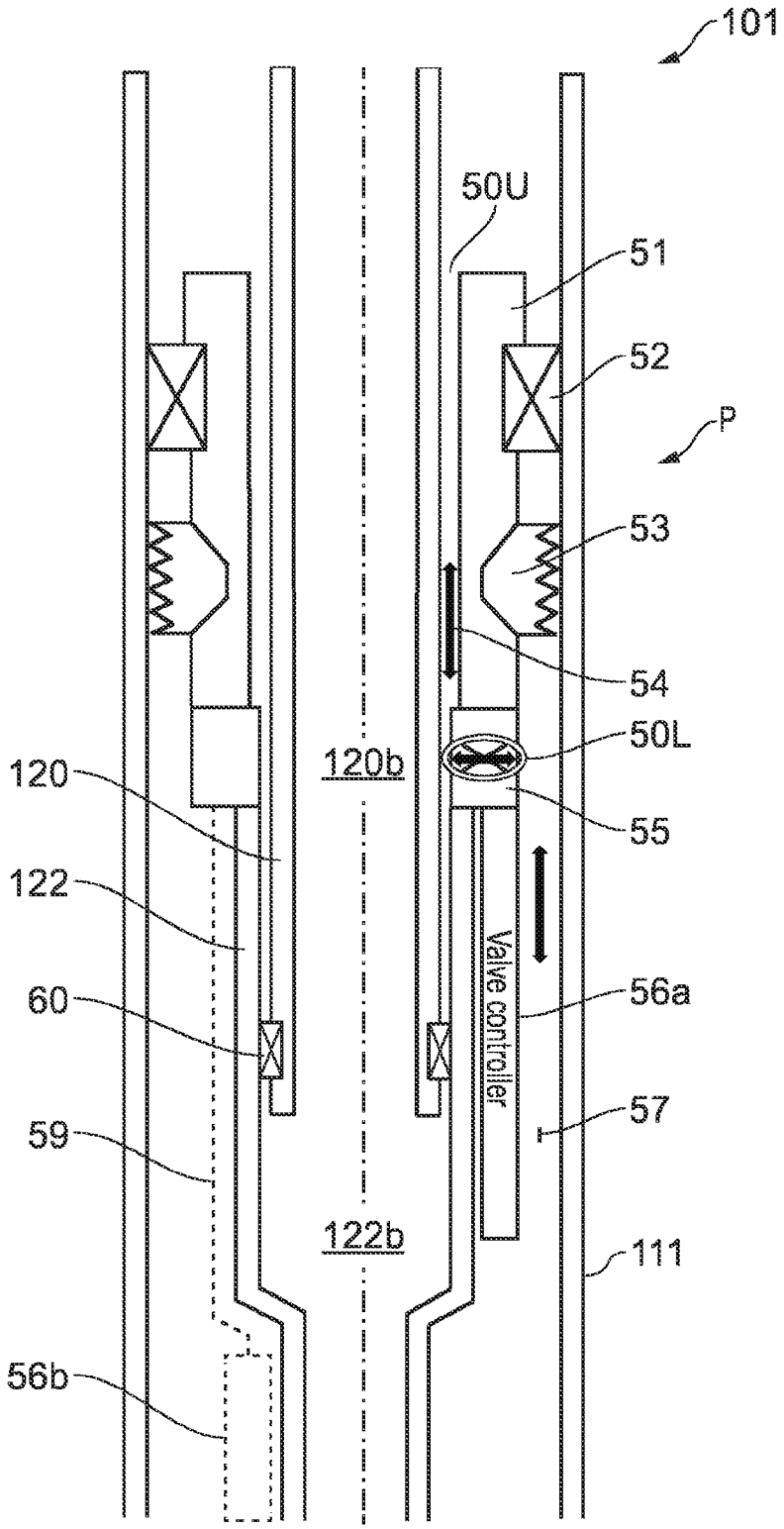
Figure 3B:
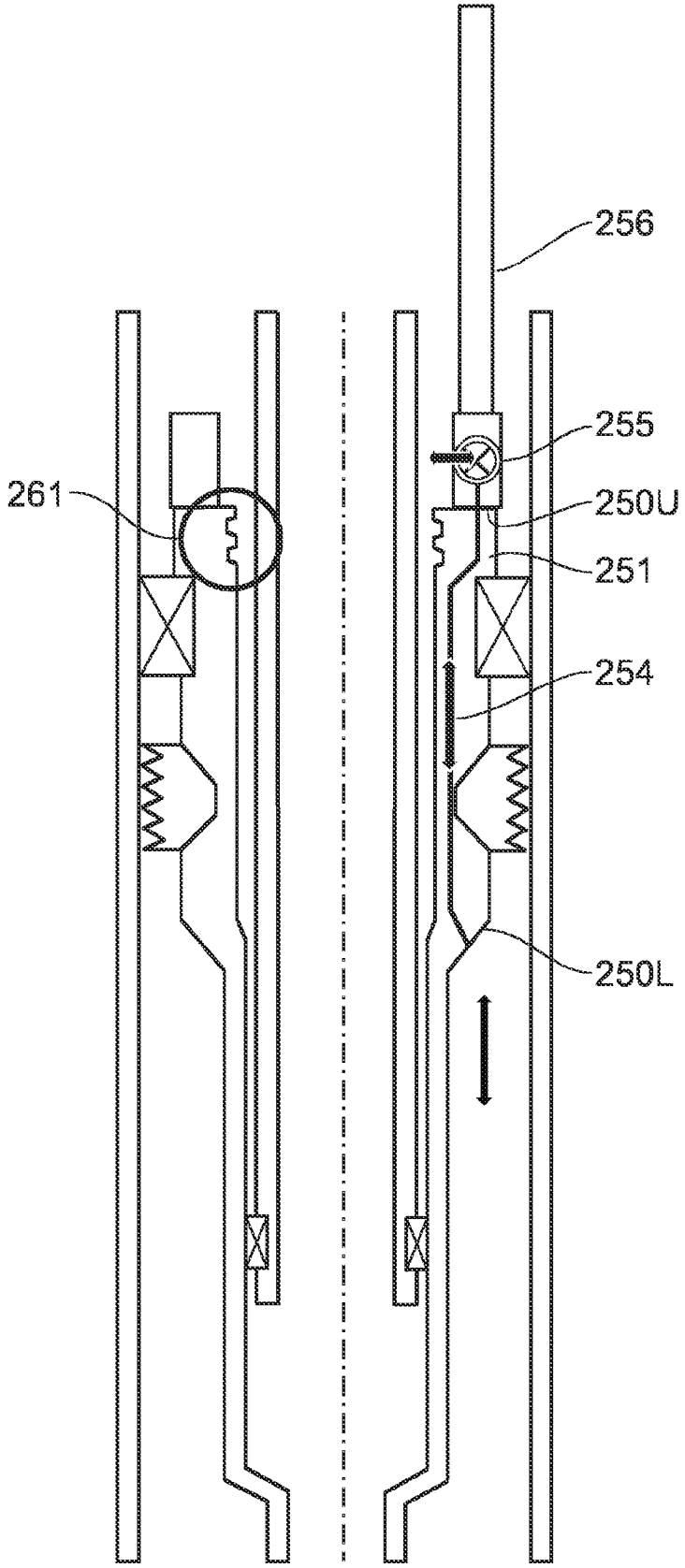
Figure 4:
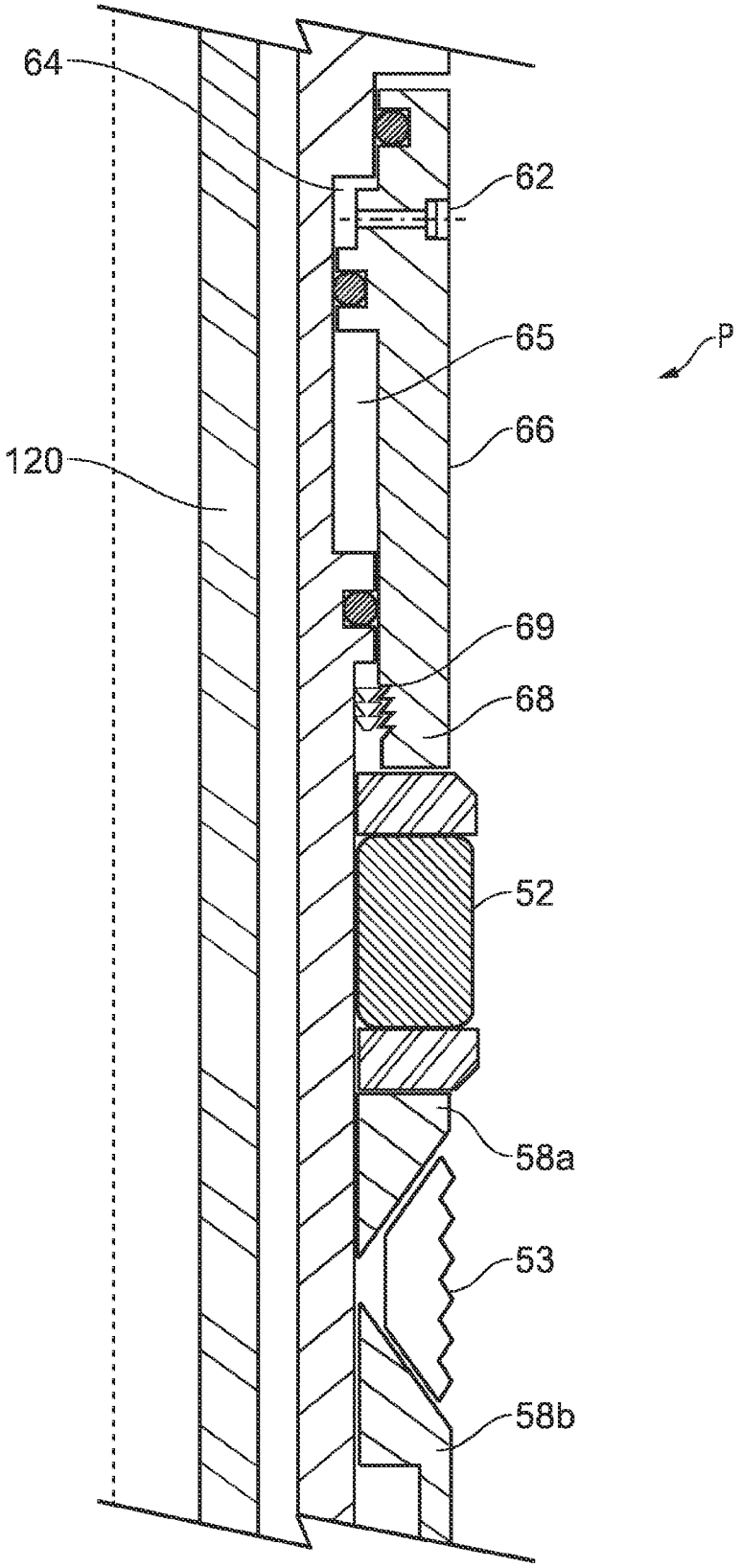
Figure 5A:
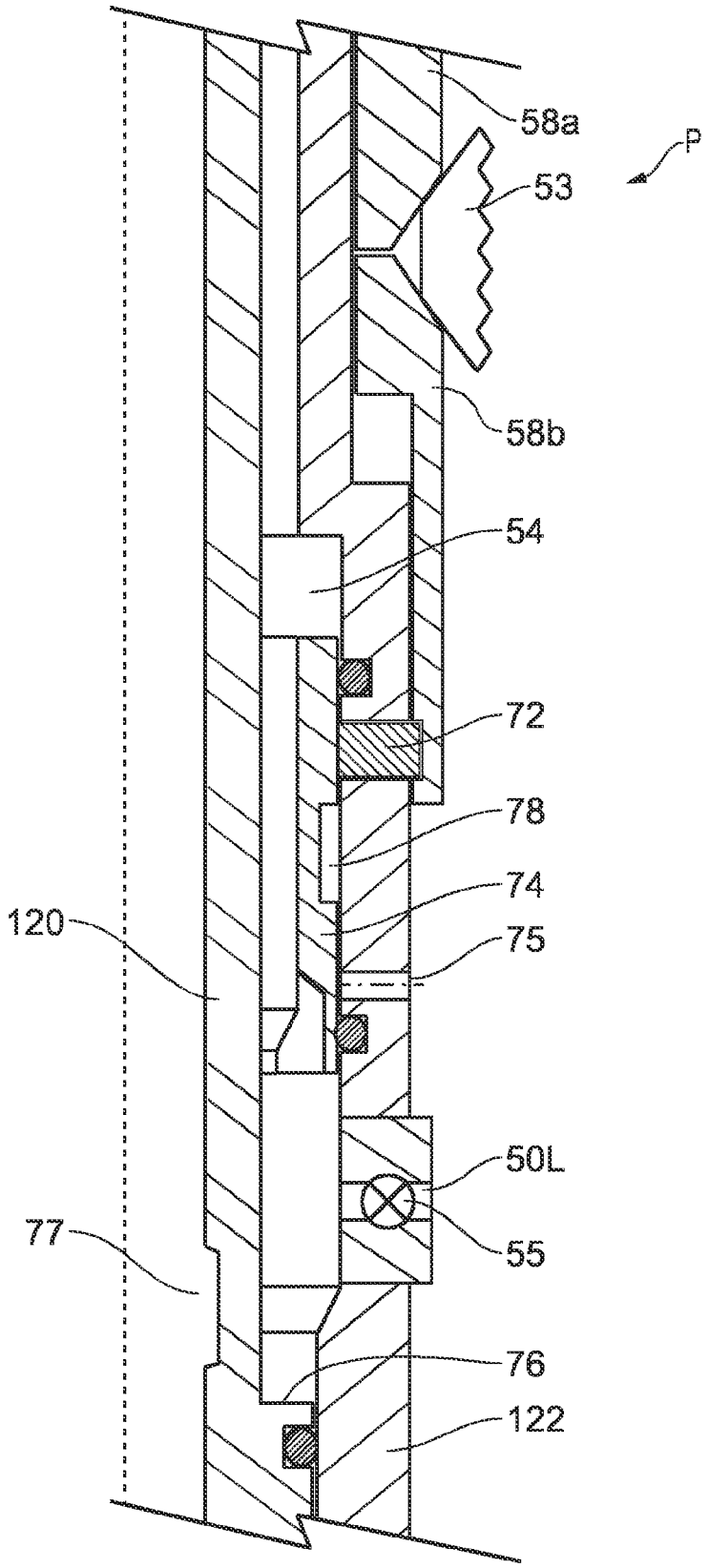
Figure 5B:
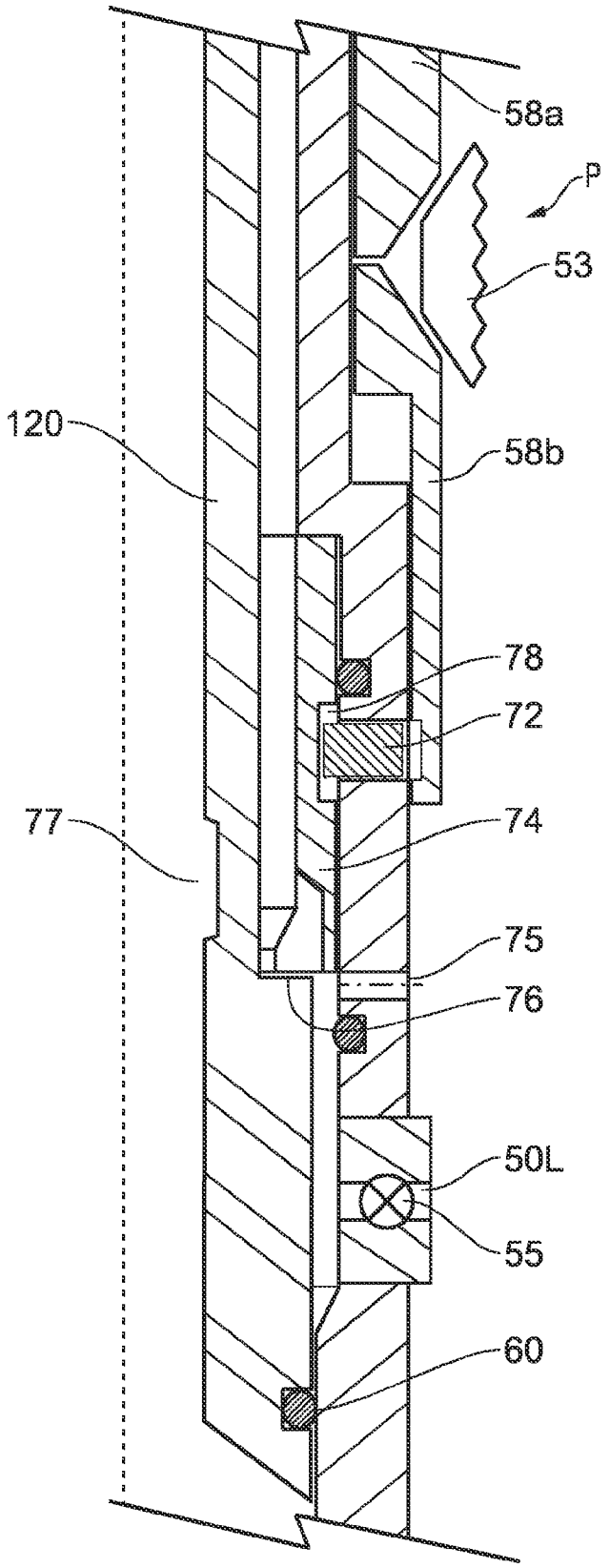
Figure 6B:
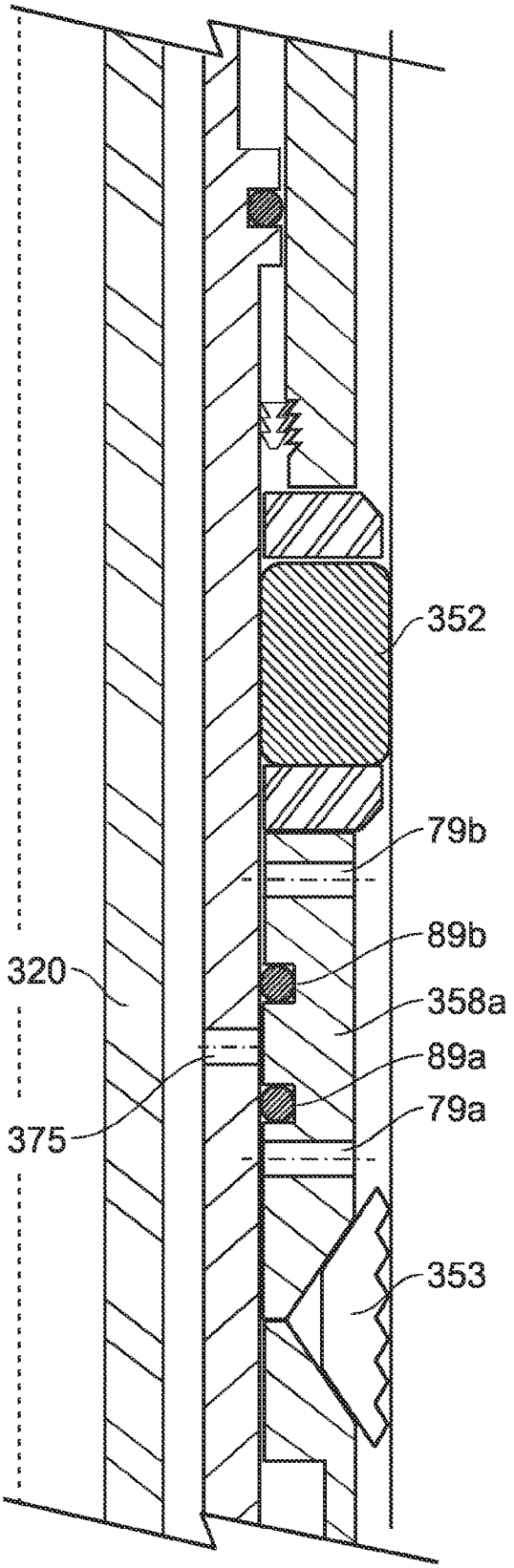
Figure 6A:
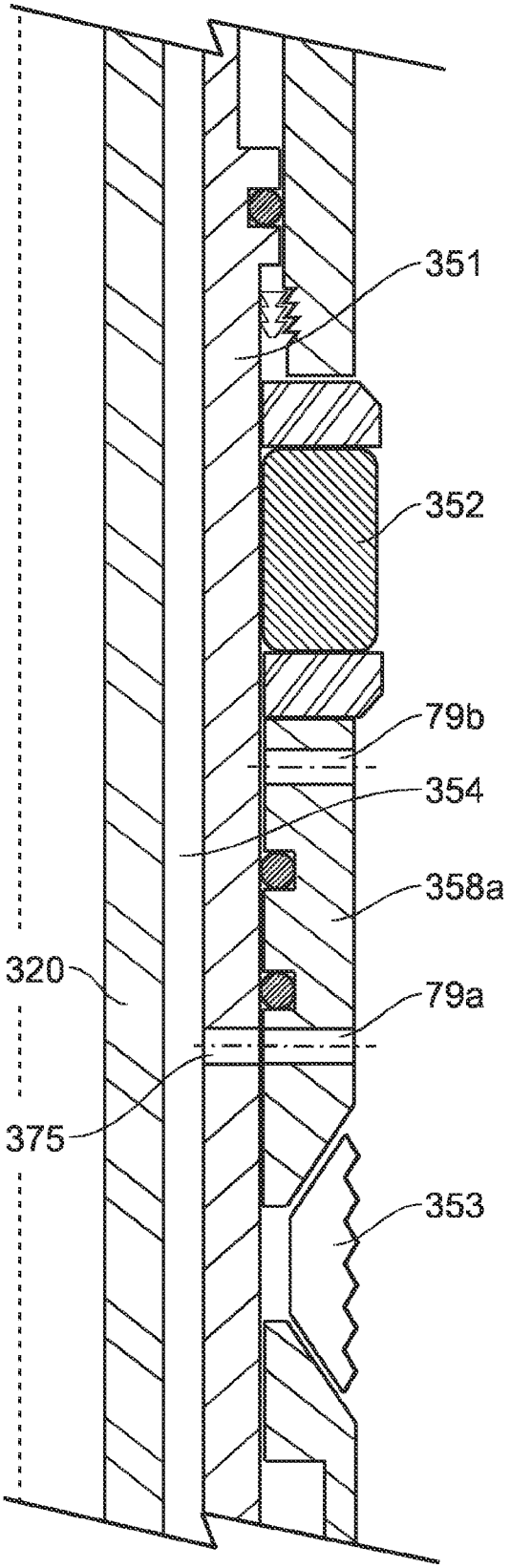
Figure 6C:
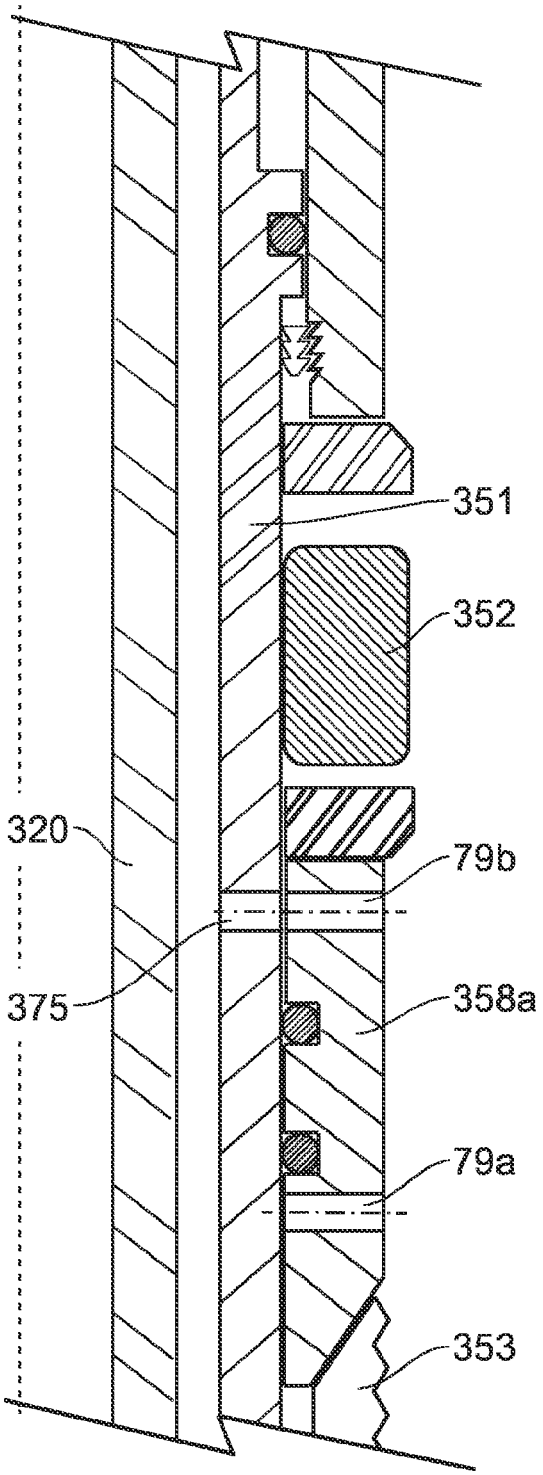

FIG. 3*a* is a diagrammatic view of the FIG. 2 packer apparatus in a well;

FIG. 3*b* is a diagrammatic view of an alternative embodiment of the packer apparatus in a well;

FIG. 4 is a schematic section of a packer apparatus including a setting mechanism in accordance with aspects of the present invention;

FIG. 5*a* is a schematic view of a lower section of the FIG. 4 packer apparatus including a primary release mechanism used in accordance with aspects of the present invention, in a set position;

FIG. 5*b* is a schematic view of the lower section of the FIG. 5*a* packer apparatus including the primary release mechanism in a released position;

FIG. 6*a* is a schematic view of an alternative embodiment of a packer apparatus in a well in a running-in position;

FIG. 6*b* is a schematic view of the FIG. 6*a* embodiment in a set position; and, FIG. 6*c* is a schematic view of the FIG. 6*a* embodiment in an unset position.

FIG. 2 shows well 101 including a packer apparatus P in accordance with aspects of the present invention.

As is conventional, the well comprises a Blow-Out-Preventor (BOP) 110 sealing a tubing string 112 in an annulus by pipe rams 113. The tubing string 112 comprises a tester valve 118 which has a circulating valve which selectively allows or resists communication between the tubing string 112 and an annulus 115 between the tubing string 112 and casing 111, and a ball valve which selectively allows or resists fluid to continue up or down the tubing string 112. A back-up circulating valve 116 is provided above the tester valve 118, should the tester valve 118 fail.

In this embodiment of the present invention, the packer apparatus comprises an internal moveable tube known as a 'stinger' 120 sealed within a sealbore extension (SBE) 122 by a floating seal 60. The stinger 120 is connected to the end of the tubing string 112 so that contraction/expansion of the tubing string 112 due to thermal, pressure and load effects is permitted by movement of the stinger 120 in the SBE 122.

The SBE 122 connects to a ported sub (or a lower circulation valve) with circulation ports 124 below the packer apparatus P. Perforating guns 126 are attached to the ported sub, and a fluid connection to the reservoir (not shown) is provided, via perforations. Typically there are several joints of tubing (not shown) between the ported sub and the perforating guns to isolate the packer from shock associated with perforating. A packer element 52 is provided in the well 101 to seal the annulus between the SBE 122 and the outer casing 111.

FIG. 3*a* shows an embodiment of a retrievable packer apparatus P in accordance with the present invention in more detail. The integral seal bore extension 122 receives the stinger 120 as described above and some relative axial movement caused by effects such as pressure/temperature fluctuations is allowed for. The floating seal 60 therebetween maintains the seal and isolates the main bore 122*b* of the seal bore extension 122 and a main bore 120*b* of the stinger 120 from a bypass channel 54 and valve 55.

The packer apparatus P comprises a mandrel 51 for mounting a packer element 52 and slips 53. The fluid bypass channel 54 is an annular channel defined by the inner diameter of the mandrel 51 and the outer diameter of the stinger 120, and terminating in upper 50U and lower 50L ports. It extends across the packer element 52 and slips 53 and is controlled wirelessly by a valve 55 and associated control electronics 56*a* positioned outside the SBE 122. The control electronics 56*a* comprises a valve controller, and an electronic communication device with a wireless receiver. The valve 55 can open and close and/or choke the lower port 50L to control fluid movement through the bypass channel 54.

In this embodiment, the bypass channel 54 is isolated from the area between the element 52 and slips 53 as there is no direct porting therebetween (when the valve 55 is open or element 52 unset there is indirect communication and some indirect communication may occur past the slips 53 even when set).

In an alternative embodiment a control electronics 56*b* (shown in phantom) may be provided below the SBE 122 and connected to the valve 55 by a hydraulic or electric line 59. The control electronics 56*b* are thus below the lowermost position of the floating seal 60, and the bypass valve 55 is above the uppermost position of the floating seal 60 within the SBE 122.

A fishing profile (not shown) may be provided on the upper end of the mandrel 51 for ease of retrieval by a fishing tool if necessary.

As shown in FIG. 2, in use, the mandrel 51, stinger 120 and the SBE 122 are run into the well-connected together, the packer element 52 and slips 53 deployed, and then a Drill Stem Test (DST) or other test is conducted. Hydrocarbon fluids from the reservoir are then produced through the lower circulation ports/valve 124, into the SBE 122, stinger 120, through the tubing string 112 to the surface. Production of the fluids is assessed to infer various characteristics of the reservoir, well etc.

After the test, production of hydrocarbons is stopped and the tubing above the tester valve 118 is then cleared of hydrocarbons by circulating fluid, such as brine, through the annulus 115, into the tubing string 112 via the tester valve 118 and to the surface. Thereafter, the circulating valve of the tester valve 118 is closed, its ball valve opened and more fluid is pumped into the tubing string 112 to direct or 'bullhead' the hydrocarbons below the tester valve 118 into the reservoir.

The annulus between the packer element 52 and the ports 124 will tend to have hydrocarbons trapped therein. To remove them, the annulus 115 above the packer apparatus P is normally pressured up and then a wireless signal sent from the surface to the control electronics 56*a* to open the valve 55. By adding fluid through choke and kill lines 99 of the BOP 110 to direct fluid through the bypass channel 54 and valve 55, the hydrocarbon gas in the area 57 is then recirculated through the ports 124 back to surface and/or bull-headed into the reservoir, all whilst the rams 113 remain closed, the packer element is sealed against the casing 111, and back-up circulation valve 116 is closed/not activated. Optionally, a further signal is sent to close the valve 55.

A further advantage of certain embodiments is that the circulating port/valve 124 below the packer P can be positioned optimally with respect to the perforations in the reservoir, whereas previously, it was positioned to minimise the distance to the packer element 52. Conventionally with the ported sub placed beneath the packer it may be difficult to displace any hydrocarbons within the tubing joints provided between the perforating gun and the circulating port, a further advantage of certain embodiments is that the circulating ports can be positioned lower in the well between the tubing joints and the perforating gun permitting these tubing joints to be more readily cleared of hydrocarbons.

FIG. 3*b* shows an alternative embodiment, with like parts sharing the same reference numeral except preceded by a '2'. In this embodiment, the valve 255 directly controls the upper port 250U rather than the lower port 250L. The bypass channel 254 extends through the mandrel 251. The control electronics 256 are provided above the packer element 252.

This can be useful where space constraints, especially for certain sizes of packers such as a 7" (17.8 cm) packer, inhibit positioning of the valve/valve controller below the packer element as in the FIG. 3*a* embodiment. Moreover, for certain embodiments, the control electronics 256 can also be conveniently combined with other electronics (not shown) such as those used to activate the packer element and slips to extend radially outwards.

A fishing profile 261 is provided at the end of the mandrel 251 on its inside for ease of retrieval by a fishing tool if necessary. The FIG. 3*b* embodiment otherwise includes the features described for the FIG. 3*a* embodiment and functions in the same way.

FIG. 4 is a schematic view of an unset packer apparatus in accordance with the present invention showing the packer element 52, slips 53 as well as a hydrostatic setting mechanism. The bypass valve 55/255 is not shown in FIG. 4, but could be provided above or below the detail shown, as described in FIGS. 3*a* and 3*b*.

To set the packer apparatus P, pressure is increased to rupture a rupture disk 62, and allow well pressure into a chamber 64 to move a hydrostatic setting piston 66 against the action of atmospheric pressure in a chamber 65. An attached ratchet housing 68 having an inner ratchet ring 69 moves with the piston 66 which in turn moves an upper annular cone 58*a* to displace the slips 53 radially outwards and then the packer element 52 radially outwards such that both engage with a casing. The ratchet ring 69 engages against a toothed profile to resist return of the packer element 52.

The well test procedure can then be conducted as described above.

FIG. 5*a* shows a lower end of the packer apparatus P illustrating a lower portion of the stinger 120, seal bore extension 122 and bypass channel 54 described above with respect to FIG. 3*a*, as well as the slips 53, and bypass valve 55. The packer apparatus P also includes a primary release mechanism including a hitherto stationary lower annular cone 58*b* which is held in place by engagement with a plurality of circumferentially spaced dogs 72 against an annular support sleeve 74.

To release the packer apparatus from engagement with well casing (not shown), the stinger 120 is pulled upwards causing a shoulder 76 thereof to abut with and move the annular support sleeve 74. The dogs 72 move into a recess 78 in the support sleeve 74 as it is aligned, as shown in FIG. 5*b*.

This then releases the lower cone 58*b*, which can move down allowing the slips 53 and packer element 52 to disengage from the well casing. Continued pulling on the stinger 2 allows the packer apparatus P including stinger 120, and seal bore extension 122 to be retrieved.

Movement of the annular support sleeve 74 connects previously sealed further bypass port 75 with the fluid bypass via channel 54 and hence facilitates pressure equalization across the packer element 52, reducing swabbing if the packer element 52 does not fully retract, and enabling easier movement of fluids past the packer element 52 once it is unset.

As an alternative, or normally in addition to the primary release mechanism, within the stinger assembly above the shoulder 76, a secondary release mechanism including a weak section 77 may be provided. The stinger 120 will break at the weak section, leaving part of the stinger within the SBE 122, if the amount of tension applied exceeds the tensile rating of the weak section 77. This enables retrieval of the tubing string above the packer in the event of inability to release the packer. A fishing tool may connect to an engagement/fishing profile, such as the profile 261 shown in FIG. 3*b* and at the same time other suitable positions in the packer apparatus, especially the primary release mechanism, such as a shoulder at the bottom of the annular support sleeve 74.

A further embodiment is shown in FIGS. 6*a*-6*c* with like parts showing the same reference numeral but preceded with a '3'. Whilst certain embodiments isolate the portion between the packer and slips from direct porting to the bypass channel, the FIG. 6*a*-6*c* embodiment includes such communication.

FIG. 6*a* shows a detail of a packer apparatus 300 in a running-in position. The packer element 352 and slips 353 are retracted. Porting 79*a* in the upper cone 358A is aligned with porting 375 in the mandrel 351 allowing bypass across the packer element 352 (which is the widest diameter part of the overall apparatus). As it is moved into the well, fluids can thus travel through the aligned ports 79*a* and 275 and the bypass channel 354 rather than past the inhibited clearance between the packer element 352 and the outer wellbore (not shown).

FIG. 6*b* shows the position when the packer element 352 and slips 353 are set in the well, following a procedure described above. The cone 358*a* has moved downwards, as described previously for other embodiments, and thus the porting 79*a* and 375 are no longer aligned, and the area between the packer 352 and slips 353 is sealed from the bypass 354 by seals 89*a* and 89*b*.

FIG. 6*c* shows the position where the packer element 352 and slips 353 are unset from the well following the procedure set out previously for other embodiments. The cone 358*a* has moved further downwards aligning the port 375 with a further port 79*b*. In this way the packer apparatus can be removed from the well, and the aligned ports and bypass prevent swabbing of the packer, as described above for bypass 75 which serves the same function for the earlier FIG. 5*a* embodiment.

The ports 79*a*, 79*b* and 375 are alternative embodiments of porting to the further port 75 in FIGS. 5*a* and 5*b* and are associated with running and unsetting of the packer. The wirelessly controllable bypass valve 55 and lower port 50L are not shown in FIGS. 6*a*-6*c* and would typically be provided outside the detail shown.

Improvements and modifications may be made without departing from invention defined in the appended claims, and their equivalents. For example, the setting mechanism may be wirelessly activated, rather than using a rupture disk. The tester valve may be provided as two discrete assemblies, one a circulation valve and the other a ball valve.

The invention claimed is:

1. A retrievable packer apparatus comprising:

a mandrel having a main longitudinal direction, the mandrel defining a throughbore in the main longitudinal direction;

a packer element mounted on the mandrel;

seal bore extension attached, directly or indirectly, to the mandrel, the seal bore extension defining a bore in the main longitudinal direction;

a floating seal between the bore of the seal bore extension and an internal moveable tube;

a bypass channel extending across the packer element between an upper bypass port and a lower bypass port, the bypass channel extending generally in said longitudinal direction;

a bypass valve controlling said upper or lower bypass port;

an electronic communication device comprising a wireless receiver configured to receive wireless signals to control the bypass valve; and wherein a bypass flow area being the minimum flow area of one of the upper bypass port, the lower bypass port, the bypass valve and the bypass channel, is from 0.05 to 2 square inches (32 to 1290 $mm^2$).

2. A packer apparatus as claimed in claim 1, wherein the bypass valve is moveable more than once.

3. A packer apparatus as claimed in claim 2, wherein the bypass valve is a multi-cycle valve.

4. A packer apparatus as claimed in claim 1, wherein the bypass valve is a single-shot valve and a bypass flow area, being the minimum flow area of one of the upper bypass port, the lower bypass port, the bypass valve and the bypass channel, is from 0.5 to 4 square inches (323 to 2581 $mm^2$).

5. A packer apparatus as claimed in claim 1, wherein the bypass valve comprises a sleeve valve.

6. A packer apparatus as claimed in claim 1, wherein the wireless signals to control the bypass valve are, at least in part, acoustic and/or electromagnetic (EM) wireless signals.

7. A packer apparatus as claimed in claim 1, wherein the wireless signals to control the bypass valve are, at least in part, coded pressure pulses.

8. A packer apparatus as claimed in claim 1, including a valve controller which controls the bypass valve.

9. A packer apparatus as claimed in claim 8, wherein the bypass valve is below the packer element, and the valve controller is provided on the outside of the seal bore extension, or below the seal bore extension, and linked to the bypass valve by a hydraulic line or electrical control line passing over, or within a wall of, the seal bore extension.

10. A packer apparatus as claimed in claim 8, wherein the bypass valve and the valve controller are provided above the packer element.

11. A packer apparatus as claimed in claim 1, wherein the bypass channel is defined, at least in part, between the internal moveable tube and the mandrel.

12. A packer apparatus as claimed in claim 1, wherein the packer apparatus includes an anchoring device such as packer slips, also provided on the mandrel and the bypass channel also extends across the anchoring device.

13. A packer apparatus as claimed in claim 1, comprising a hydrostatic setting mechanism including a low-pressure chamber, an external port and a piston configured to be driven by well pressure against the action of the low-pressure chamber.

14. A packer apparatus as claimed in claim 13, wherein the hydrostatic setting mechanism includes a trigger device which can allow well pressure through the port into a drive chamber to move the piston.

15. A packer apparatus as claimed in claim 14, wherein the trigger device comprises an electronic receiver to receive wireless control signals.

16. A packer apparatus as claimed in claim 1, comprising a primary release mechanism activatable by movement of the internal moveable tube.

17. A packer apparatus as claimed in claim 16, wherein the primary release mechanism comprises a moveable annular support sleeve provided between the internal moveable tube and the mandrel, and wherein the moveable annular support sleeve includes a shoulder engageable with a complementary shoulder on the internal moveable tube and further comprising a releasable support member arranged to hold, directly or indirectly, the packer element in a sealing position, and a plurality of dogs, the dogs moveable from a first position, which engages with the releasable support member and resists movement thereof relative to the mandrel, and a second position where the dogs extend into a recess defined in the moveable annular support sleeve and allow movement of the releasable support member relative to the mandrel.

18. A packer apparatus as claimed in claim 16, configured such that said movement of the internal moveable tube opens a further bypass port below the packer element which during retrieval allows fluid communication across the packer element via at least a portion of the bypass channel.

19. A packer apparatus as claimed in claim 16 configured such that following operation of the primary release mechanism the packer apparatus is retrievable in use by continued upward pulling of the internal moveable tube.

20. A packer apparatus as claimed in claim 1, wherein a secondary release mechanism includes a weak section in the internal moveable tube which is shearable at a pre-determined force, wherein normally the upper part of the internal moveable tube is retrievable without retrieving a lower portion of the packer.

21. A packer apparatus as claimed in claim 1 having a packer gauge diameter greater than 5.75" (14.6 cm) and less than 8.6" (22 cm).

22. A packer apparatus as claimed in claim 1, wherein the floating seal has a minimum inner diameter of at least 2.2" (5.6 cm) and maximum inner diameter of 2.5" (6.4 cm).

23. A retrievable packer apparatus comprising:

a mandrel having a main longitudinal direction, the mandrel defining a throughbore in the main longitudinal direction;

a packer element mounted on the mandrel;

seal bore extension attached, directly or indirectly, to the mandrel, the seal bore extension defining a bore in the main longitudinal direction;

a floating seal between the bore of the seal bore extension and an internal moveable tube;

a bypass channel extending across the packer element between an upper bypass port and a lower bypass port, the bypass channel extending generally in said longitudinal direction;

a bypass valve controlling said upper or lower bypass port;

an electronic communication device comprising a wireless receiver configured to receive wireless signals to control the bypass valve;

and, at least one battery optionally a rechargeable battery, and/or a microprocessor.

24. A packer apparatus as claimed in claim 23, wherein the bypass valve is moveable more than once.

25. A packer apparatus as claimed in claim 24, wherein the bypass valve is a multi-cycle valve.

26. A packer apparatus as claimed in claim 24, wherein a bypass flow area being the minimum flow area of one of the upper bypass port, the lower bypass port, the bypass valve and the bypass channel, is from 0.05 to 2 square inches (32 to 1290 $mm^2$).

27. A packer apparatus as claimed in claim 23, wherein the bypass valve is a single-shot valve and a bypass flow area, being the minimum flow area of one of the upper bypass port, the lower bypass port, the bypass valve and the bypass channel, is from 0.5 to 4 square inches (323 to 2581 $mm^2$).

28. A packer apparatus as claimed in claim 23, wherein the bypass valve comprises a sleeve valve.

29. A packer apparatus as claimed in claim 23, wherein the wireless signals to control the bypass valve are, at least in part, acoustic and/or electromagnetic (EM) wireless signals.

30. A packer apparatus as claimed in claim 23, wherein the wireless signals to control the bypass valve are, at least in part, coded pressure pulses.

31. A packer apparatus as claimed in claim 23, including a valve controller which controls the bypass valve.

32. A packer apparatus as claimed in claim 31, wherein the bypass valve is below the packer element, and the valve controller is provided on the outside of the seal bore extension, or below the seal bore extension, and linked to the bypass valve by a hydraulic line or electrical control line passing over, or within a wall of, the seal bore extension.

33. A packer apparatus as claimed in claim 31, wherein the bypass valve and the valve controller are provided above the packer element.

34. A packer apparatus as claimed in claim 23, wherein the bypass channel is defined, at least in part, between the internal moveable tube and the mandrel.

35. A packer apparatus as claimed in claim 23, wherein the packer apparatus includes an anchoring device such as packer slips, also provided on the mandrel and the bypass channel also extends across the anchoring device.

36. A packer apparatus as claimed in claim 23, comprising a hydrostatic setting mechanism including a low-pressure chamber, an external port and a piston configured to be driven by well pressure against the action of the low-pressure chamber.

37. A packer apparatus as claimed in claim 36, wherein the hydrostatic setting mechanism includes a trigger device which can allow well pressure through the port into a drive chamber to move the piston.

38. A packer apparatus as claimed in claim 37, wherein the trigger device comprises an electronic receiver to receive wireless control signals.

39. A packer apparatus as claimed in claim 23, comprising a primary release mechanism activatable by movement of the internal moveable tube.

40. A packer apparatus as claimed in claim 39, wherein the primary release mechanism comprises a moveable annular support sleeve provided between the internal moveable tube and the mandrel, and wherein the moveable annular support sleeve includes a shoulder engageable with a complementary shoulder on the internal moveable tube and further comprising a releasable support member arranged to hold, directly or indirectly, the packer element in a sealing position, and a plurality of dogs, the dogs moveable from a first position, which engages with the releasable support member and resists movement thereof relative to the mandrel, and a second position where the dogs extend into a recess defined in the moveable annular support sleeve and allow movement of the releasable support member relative to the mandrel.

41. A packer apparatus as claimed in claim 39, configured such that said movement of the internal moveable tube opens a further bypass port below the packer element which during retrieval allows fluid communication across the packer element via at least a portion of the bypass channel.

42. A packer apparatus as claimed in claim 39, configured such that following operation of the primary release mechanism the packer apparatus is retrievable in use by continued upward pulling of the internal moveable tube.

43. A packer apparatus as claimed in claim 23, wherein a secondary release mechanism includes a weak section in the internal moveable tube which is shearable at a pre-determined force, wherein normally the upper part of the internal moveable tube is retrievable without retrieving a lower portion of the packer.

44. A packer apparatus as claimed in claim 23 having a packer gauge diameter greater than 5.75" (14.6 cm) and less than 8.6" (22 cm).

45. A packer apparatus as claimed in claim 23, wherein the floating seal has a minimum inner diameter of at least 2.2" (5.6 cm) and maximum inner diameter of 2.5" (6.4 cm).

46. A well comprising the packer apparatus as claimed in claim 23, comprising:

a tubing string sealed by rams of a blow-out preventor;

the tubing string extending into casing of the well defining an annulus therebetween;

the tubing string connected to the internal moveable tube of the packer apparatus;

wherein the packer element provides a seal between the casing and the mandrel of the packer apparatus.

47. A well as claimed in claim 46 comprising a circulation valve below the packer apparatus.

48. A well as claimed in claim 46, wherein the tubing string includes a circulating valve and a ball valve above and within 100 m of the packer element.

49. A method of controlling a well as claimed in claim 46, the well being in communication with a reservoir, the method comprising:

a. sending a wireless signal to the wireless receiver to cause the bypass valve to open;

b. directing fluid through the bypass channel.

50. A method as claimed in claim 49, wherein the bypass valve is opened whilst the rams are engaged on the tubing string.

51. A method as claimed in claim 49, wherein the bypass valve is opened whilst the packer element is engaged on the casing.

52. A method as claimed in claim 49, wherein fluid is circulated to surface via the bypass channel and a circulation port or valve below the packer apparatus.

53. A well comprising the packer apparatus as claimed in claim 1, comprising:

a tubing string sealed by rams of a blow-out preventor;

the tubing string extending into casing of the well defining an annulus therebetween;

the tubing string connected to the internal moveable tube of the packer apparatus;

wherein the packer element provides a seal between the casing and the mandrel of the packer apparatus.

54. A well as claimed in claim 53 comprising a circulation valve below the packer apparatus.

55. A well as claimed in claim 53, wherein the tubing string includes a circulating valve and a ball valve above and within 100 m of the packer element.

56. A method of controlling a well as claimed in claim 53, the well being in communication with a reservoir, the method comprising:

a. sending a wireless signal to the wireless receiver to cause the bypass valve to open;

b. directing fluid through the bypass channel.

57. A method as claimed in claim 56, wherein the bypass valve is opened whilst the rams are engaged on the tubing string.

58. A method as claimed in claim 56, wherein the bypass valve is opened whilst the packer element is engaged on the casing.

59. A method as claimed in claim 56, wherein fluid is circulated to surface via the bypass channel and a circulation port or valve below the packer apparatus.

* * * * *